US006640345B2

(12) United States Patent
Tanaka

(10) Patent No.: US 6,640,345 B2
(45) Date of Patent: Nov. 4, 2003

(54) FULL-FACE TYPE HELMET FOR VEHICULAR USERS

(75) Inventor: Haruo Tanaka, Tokyo (JP)

(73) Assignee: Kabushiki Kaisha Shoei, Tokyo (JP)

( * ) Notice: Subject to any disclaimer, the term of this patent is extended or adjusted under 35 U.S.C. 154(b) by 0 days.

(21) Appl. No.: 10/161,581

(22) Filed: Jun. 3, 2002

(65) Prior Publication Data

US 2003/0005510 A1 Jan. 9, 2003

(30) Foreign Application Priority Data

Jul. 3, 2001 (JP) ..... 2001-202345

(51) Int. Cl.[7] ..... A42B 1/06
(52) U.S. Cl. ..... 2/410; 2/171.3; 2/424
(58) Field of Search ..... 2/410, 424, 422, 2/171.3, 425, 436

(56) References Cited

U.S. PATENT DOCUMENTS

| | | | | | |
|---|---|---|---|---|---|
| 3,838,466 | A | * | 10/1974 | Poirier | 2/436 |
| 4,514,864 | A | * | 5/1985 | Huber | 2/424 |
| 4,667,348 | A | * | 5/1987 | Sundahl | 2/410 |
| 6,405,382 | B2 | * | 6/2002 | Shida | 2/171.3 |
| 2002/0104153 | A1 | * | 8/2002 | Benedict et al. | 2/424 |

FOREIGN PATENT DOCUMENTS

| | | | | |
|---|---|---|---|---|
| DE | 3233467 | A1 * | 3/1984 | A42B/3/02 |
| EP | 474941 | A1 * | 3/1992 | A42B/3/24 |
| JP | 01-39690 | | 11/1989 | |
| JP | 02091205 | A * | 3/1990 | A42B/3/28 |
| JP | 02-87029 | | 7/1990 | |

* cited by examiner

*Primary Examiner*—Rodney M. Lindsey
(74) *Attorney, Agent, or Firm*—Carrier, Blackman & Associates, P.C.; Joseph P. Carrier; William D. Blackman

(57) ABSTRACT

In a full-face helmet including a chin-covering portion provided on a cap body to define a space for breathing of a user, the chin-covering portion includes a lower end edge which is formed to be directed upwards in a backward direction on wearing position of the cap body, and bulges formed at left and right outer surfaces thereof to be continuous to the lower end edge. Therefore, travel wind is passed on outer surfaces of the bulges to traverse the lower end edge, thereby generating a negative pressure or vacuum at a lower portion of the chin-covering portion to draw out the user's breath in the breathing space to below the chin-covering portion. Thus, the fogging of an inner surface of a shield plate is prevented without deteriorating the strength of the chin-covering portion.

11 Claims, 7 Drawing Sheets

FULL-FACE TYPE HELMET FOR VEHICULAR USERS

BACKGROUND OF THE INVENTION

1. Field of the Invention

The present invention relates to a helmet used by a motorcycle rider and the like, and particularly to a full-face type helmet including a chin-covering portion provided on a cap body to define a space for breathing of a user, while forming a lower portion under a window in a front face of the cap body.

2. Description of the Related Art

When such a full-face type helmet is used with the window covered by a shield plate, an inner surface of the shield plate is liable to be fogged by the breath exhaled by the user, particularly in a winter season in which there is a large difference in temperature between the inside and outside of the shield plate. The following helmets designed to overcome such fogging have been conventionally known:

(1) A helmet in which a mask made of an elastic material for covering the user's nose and mouth is mounted on an inner wall of a chin-covering portion by a fastener, and a breathing bore is provided in a lower portion of the mask to permit the inside of the mask to communicate with an area below the chin-covering portion, and guide the user's breath to below the chin-covering portion by the mask, thereby preventing the fogging of the inner surface of the shield plate (see Japanese Utility Model Publication No. 1-39690).

(2) A helmet in which discharge bores are provided in left and right sidewalls of a chin-covering portion, so that a negative pressure or vacuum is generated in the discharge bores by travel wind flowing on an outer surface of the chin-covering portion, whereby the user's breath is drawn through the discharge bores to the outside to prevent an inner surface of a shield plate from being fogged (see Japanese Utility Model Publication No. 2-87029).

In the helmet described in the item (1), the mask having a special structure is required, so that an increase in cost is unavoidable. In the helmet described in the item (2), the strength of a shell of the chin-covering portion is deteriorated to some extent due to the discharge bores.

SUMMARY OF THE INVENTION

Accordingly, it is an object of the present invention to provide a full-face type helmet for vehicular users, which is of a simplified structure and which is designed so that the strength of the chin-covering portion cannot be deteriorated, and the user's breath is drawn effectively to below the chin-covering portion to prevent the inner surface of the shield plate from being fogged.

To achieve the above object, according to a first aspect and feature of the present invention, there is provided a full-face type helmet for vehicular users, comprising a chin-covering portion provided on a cap body to define a space for breathing of a user, while forming a lower portion under a window in a front face of the cap body, wherein the chin-covering portion includes a lower end edge which is formed to be directed upwards in a backward direction on wearing position of the cap body, and bulges formed at left and right outer surfaces of the chin-covering portion to be continuous to the lower end edge, so that travel wind is passed on outer surfaces of the bulges to traverse the lower end edge, thereby generating a negative pressure or vacuum at a lower portion of the chin-covering portion.

With the above arrangement of the first feature, if a user drives a vehicle to travel with the cap body put on his head, the travel wind passed on the bulges formed at the left and right outer surfaces of the chin-covering portion traverses the lower end edge of the chin-covering portion, whereby a negative pressure or vacuum is generated in the vicinity of the lower end edge behind the bulges. Thus, the user's breath in the breathing space can be drawn effectively to below the chin-covering portion, thereby preventing the fogging of an inner surface of a shield plate due to the breath. Moreover, it is unnecessary to attach a mask of a special structure to the chin-covering portion and to provide a discharge bore in the chin-covering portion as in the prior art helmet. Therefore, the chin-covering portion has a simple structure, and suffers no reduction in strength of the chin-covering portion.

According to a second aspect and feature of the present invention, in addition to the first feature, the chin-covering potion has breath-discharge recesses provided in its inner surface at locations corresponding to the bulges to open at the lower portion of the chin-covering portion.

With the above arrangement of the second feature, the breath-discharge recesses are located in the vicinity of the bulges where a negative pressure or vacuum is generated. Therefore, the negative pressure or vacuum is applied well to the recesses, whereby the breath draw-out effect can be enhanced.

According to a third aspect and feature of the present invention, in addition to the first or second feature, the bulges are formed by outwardly bulging a lower end of a shell of the chin-covering portion.

With the arrangement of the third feature, the breath-discharge recesses can be formed on the inner surface of the chin-covering portion as deeply as the lower end of the shell of the chin-covering portion bulges outwards, whereby the breath draw-out effect can be further enhanced.

Further, according to a fourth aspect and feature of the present invention, in addition to the first or second feature, the bulges are integrally formed on an outer surface of a beading member mounted to a peripheral edge of a lower end of a shell of the cap body.

With the arrangement of the fourth feature, since the bulges can be formed simultaneously with the formation of the beading member, the formation of the bulges is facilitated.

Yet further, according to a fifth aspect and feature of the present invention, in addition to the first or second feature, the chin-covering portion has a protruding wall formed on its inner surface to extend along the lower portion under the window, and a baffle plate for inhibiting the ascending of the user's breath is mounted on the protruding wall to protrude downwards.

With the arrangement of the fifth feature, the downward discharge of the breath in the breathing space can be promoted to increase the effect of preventing the fogging of an inner surface of a shield plate.

According to a sixth aspect and feature of the present invention, in addition to the fifth feature, the full-face type helmet further comprises a breath-discharge plate disposed in the chin-covering portion, the breath-discharge plate including: a louver extending forwards from a lower end of the baffle plate to define a horizontal passage between the louver itself and a lower surface of the projecting wall and having a plurality of ventilating bores; a guide plate bent downwards from a front end of the louver along an inner surface of the chin-covering portion; and a pair of left and right discharge passages defined in left and right opposite ends of the guide plate to permit the passage to communicate with the breath-discharge recesses.

With the arrangement of the sixth feature, when a negative pressure generated behind the bulges at left and right outer surfaces of the chin-covering portion due to the travel wind passing on the bulges, acts on the breath-discharge recesses in left and right inner surfaces of the chin-covering portion, the negative pressure is passed through the discharge passages and the horizontal passage, to act on the louver. Therefore, the breath of a user is passed through a plurality of ventilating bores in the louver into the passage by the draw-in effect of the negative pressure, and flows smoothly to the outside through the left and right discharge passages and the left and right recesses. As a result, the discharge of the breath to below the chin-covering portion can be promoted more effectively to increase the effect of preventing the fogging of an inner surface of a shield plate.

The above and other objects, features and advantages of the invention will become apparent from the following description of the preferred embodiment taken in conjunction with the accompanying drawings.

DESCRIPTION OF THE PREFERRED EMBODIMENTS

The present invention will now be described by way of embodiments with reference to the accompanying drawings.

Figure 1:
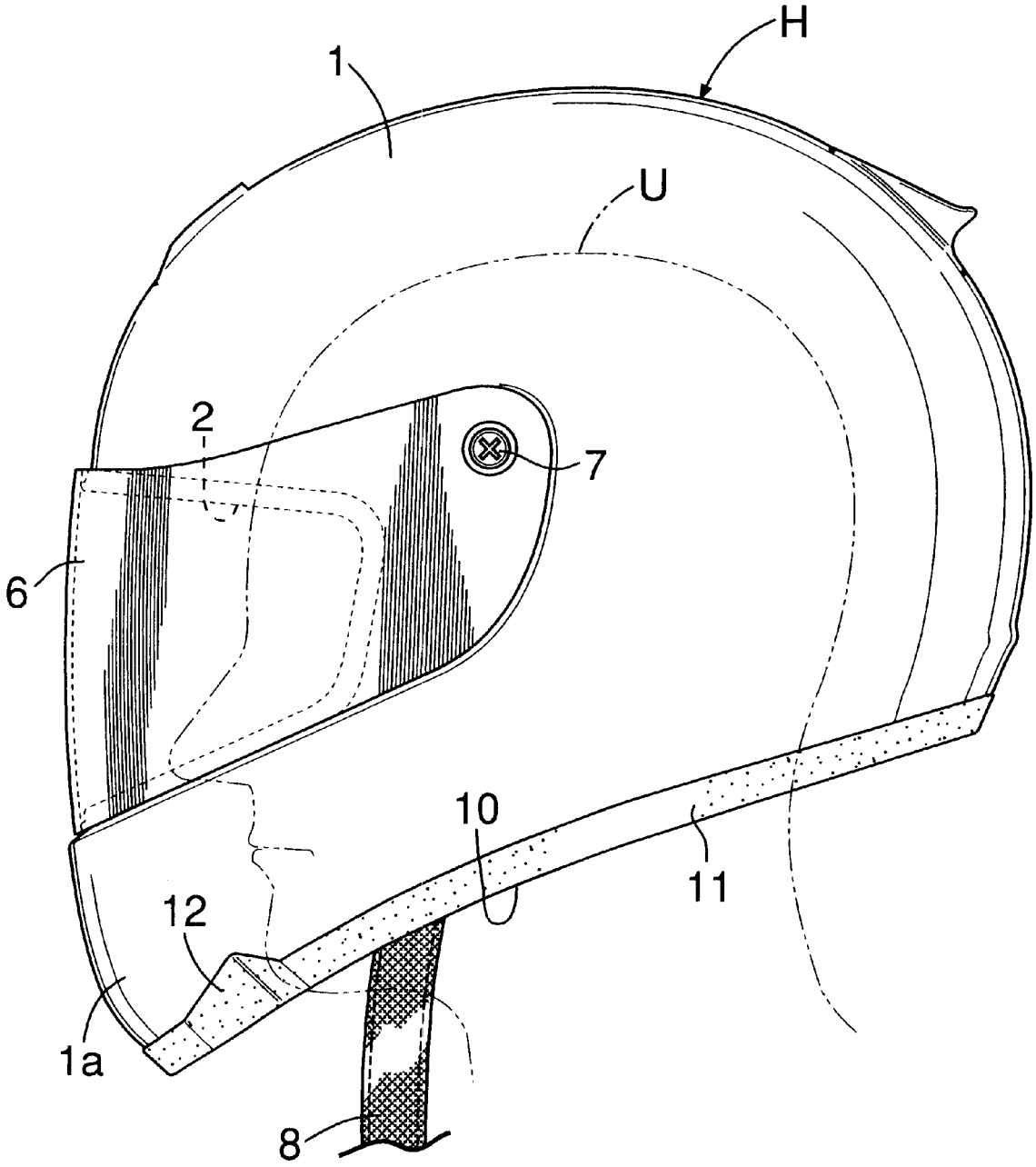
FIG. 1 is a side view of a full-face type helmet for vehicular users according to a first embodiment of the present invention.
Figure 2:
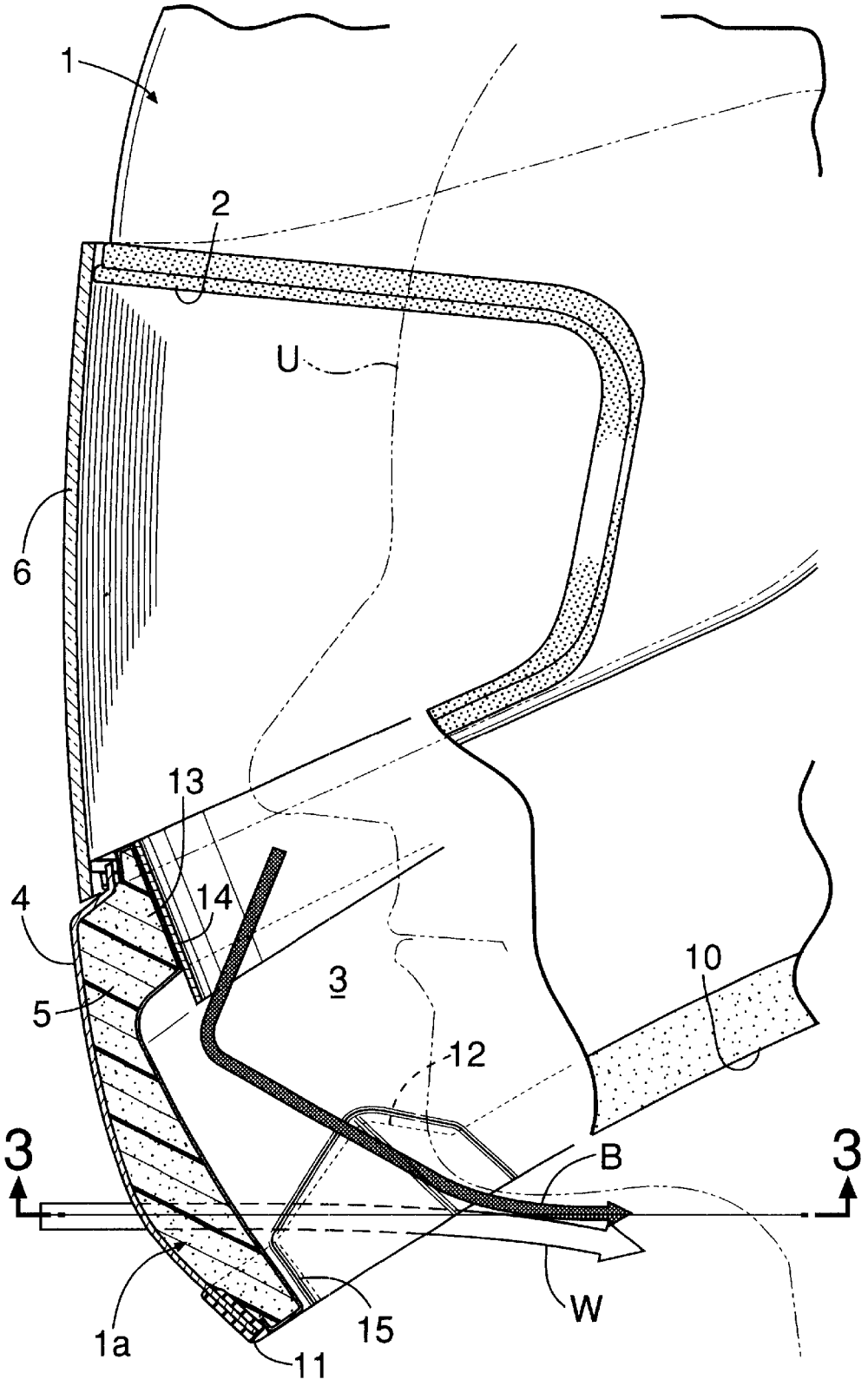
FIG. 2 is an enlarged sectional side view of an essential portion of the helmet shown in FIG. 1.

First, a first embodiment of the present invention will be described. Referring to FIGS. 1 and 2, reference symbol H designates a full-face type helmet for a motorcycle rider. The helmet H includes a cap body 1 which is formed into a full-face type including a chin-covering portion 1*a* defining an breathing space 3 for a user, i.e., a rider U, while forming a lower portion under a window 2 which opens in a front face of the cap body 1. The cap body 1 comprises a shell 4 made of a fiber-reinforced synthetic resin, and a buffering liner 5 fitted to an inner surface of the shell 4. A shield plate 6 made of a translucent synthetic resin is pivotably mounted to the shell 4 by a pivot 7 to vertically open and close the window 2. A chin belt 8 is connected at its base end to the shell 4.

A lower end edge 10 of the cap body 1 including the chin-covering portion 1*a* is formed to incline upwards in a backward direction from its front end to its rear end as viewed from the side, when the rider U assumes an attitude for steering a motorcycle with the cap body 1 on his head.

Figure 3:
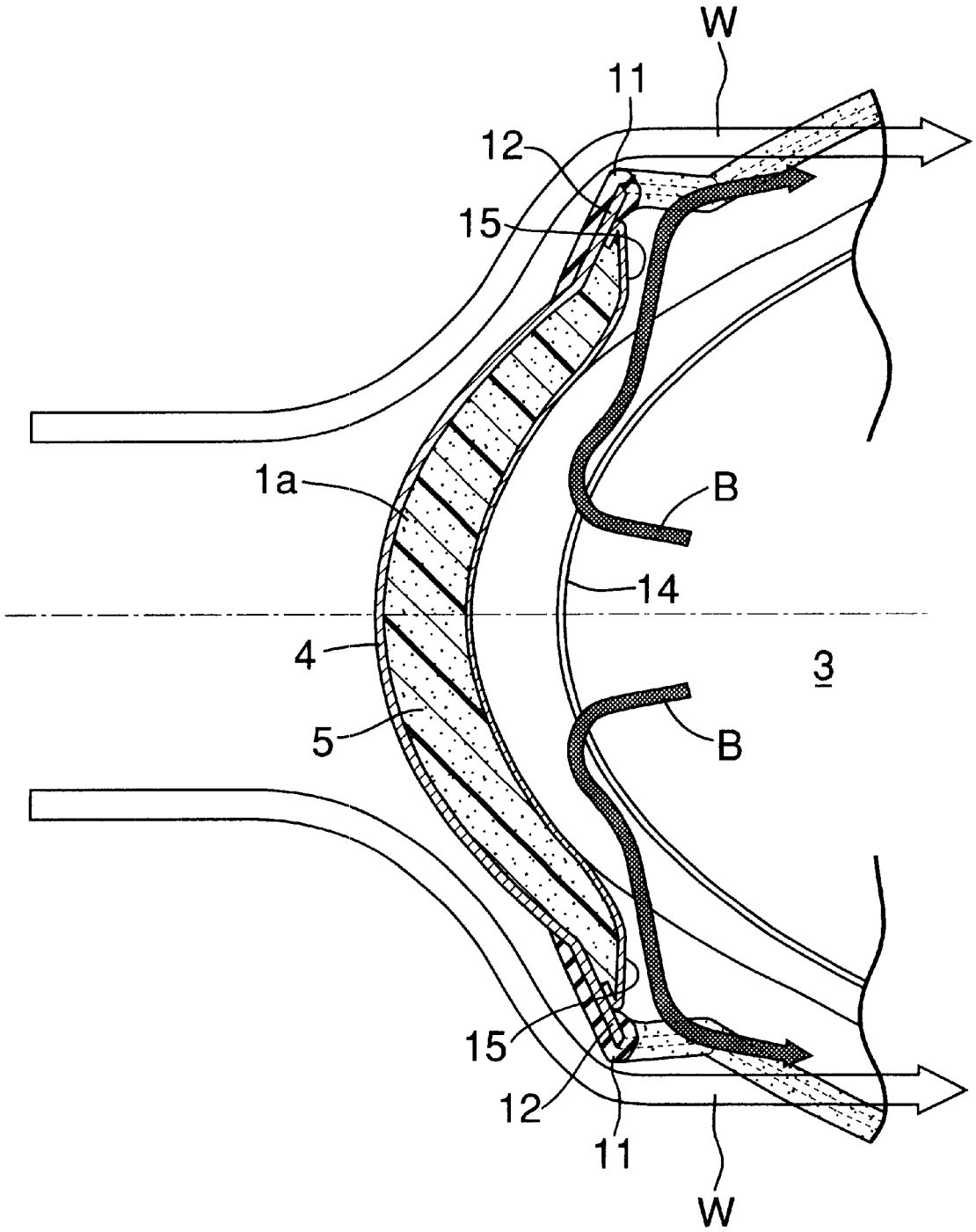
FIG. 3 is a sectional view taken along a line 3—3 in FIG. 2.

As shown in FIGS. 1 to 3, a bulge 12 is integrally formed at each of left and right outer surfaces of the chin-covering portion 1*a* so that it is continuous to the lower end edge 10 of the chin-covering portion 1*a*. Thus, travel wind W generated by traveling of the motorcycle is passed on an outer surface of the bulge 12 to traverse the lower end edge 10, whereby a negative pressure or vacuum is generated at the lower portion of the chin-covering portion 1*a*.

The bulge 12 is formed by outwardly bulging the lower end of the shell 4 of the chin-covering portion 1*a*. A breath-discharge recess 15 is defined in correspondence to each of the bulges 12 at each of left and right inner walls of the buffering liner 5 within the chin-covering portion 1*a*, and opens downwards.

As shown in FIG.2, a protruding wall 13 is formed on the inner surface of the chin-covering portion 1*a* to extend along a lower portion under the window 2. A baffle plate 14 for inhibiting the ascending of the rider U's breath toward the shield plate 6 is mounted to the protruding wall 13 to protrude downwards.

A beading member 11 for forming the lower end edge 10 is fitted and bonded to an entire peripheral edge of the lower end of the shell 4.

The operation of the first embodiment will be described below.

When the rider U wearing the helmet H of the present invention drives the motorcycle to travel, the travel wind W flows on the outer surface of the cap body 1 of the helmet H. In this case, in a usual steering attitude of the rider U, the lower end edge 10 of the cap body 1 is inclined upwards in the backward direction, and hence the travel wind W passed through the bulges 12 at the left and right outer surfaces of the chin-covering portion 1*a* traverses the lower end 10 of the chin-covering portion 1*a*. As a result, a negative pressure or vacuum is generated in the vicinity of the lower end edge 10 behind the bulges 12 and applied to the breathing space 3 within the chin-covering portion 1*a*. Thus, the breath B of the rider U discharged into the breathing space 3 within the chin-covering portion 1*a* is effectively drawn to below the chin-covering portion 1*a*. In this manner, the fogging of the inner surface of the shield plate 6 due to the breath B can be prevented.

Particularly, the bulges 12 are formed by outwardly bulging the lower end of the shell 4 corresponding to the chin-covering portion 1*a*. In correspondence to the bulges 12, the breath-discharge recesses 15 are defined at left and right inner surfaces of the buffering liner 5 within the chin-covering portion 1*a*, and open downwards. Therefore, the recesses 15 for breath outlets are located in vicinity of the negative pressure-generating portions of the bulges 12, and thus the negative pressure or vacuum acts well on the recesses 15, leading to an enhancement in breath draw-out effect.

In addition, the breath-discharge recesses 15 on the inner surface of the chin-covering portion 1*a* can be formed as deeply as the lower end of the shell 4 corresponding to the chin-covering portion 1*a* protrudes outwards to form the bulges 12, whereby the breath draw-out effect can be further enhanced.

Moreover, it is unnecessary to attach a mask of a special structure to the chin-covering portion 1*a* and to provide a discharge bore in the chin-covering portion 1*a*, as in the prior art helmet. Therefore, the chin-covering portion 1*a* is of a simplified structure and a reduction in strength of the chin-covering portion 1*a* cannot be brought about.

In this case, the provision of the baffle plate 14 for inhibiting the ascending of the breath B toward the shield plate 6 on the protruding wall 13 extending along the lower portion under the window 2 on the inner surface of the chin-covering portion 1*a*, effectively promotes the discharge of the breath B to below the chin-covering portion 1*a*, to enhance the effect of preventing the fogging of the inner surface of the shield plate 6.

Figure 4:
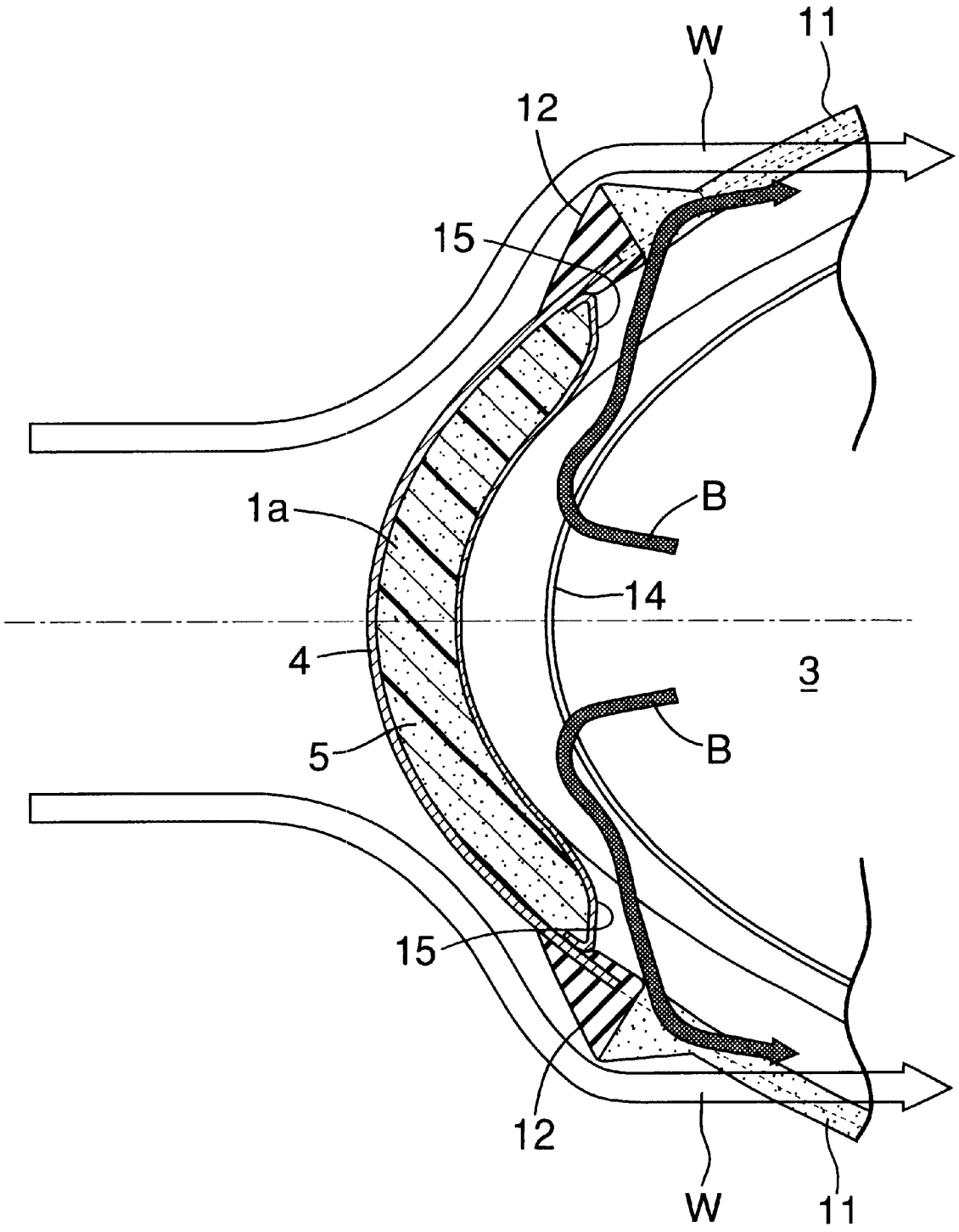
FIG. 4 is a sectional view similar to FIG. 3, but showing a helmet according to a second embodiment of the present invention.

A second embodiment of the present invention will now be described with reference to FIG. 4.

The second embodiment is of an arrangement similar to that in the first embodiment, except that bulges 12 are integrally formed at left and right outer surfaces, corresponding to a chin-covering portion 1*a*, of a beading member 11 fitted and bonded to an entire peripheral edge of a lower end of a shell 4 so that the bulges 12 are continuous to the lower end edge 10. In FIG. 4, portions or components corresponding to those in the previous embodiment are denoted by the same reference numerals and symbols, and the description of them is omitted.

In the second embodiment, the bulges 12 can be formed simultaneously with the formation of the beading member 11. Therefore, it is easy to form the bulges 12 and hence, it is possible to provide the helmet at a low cost.

Figure 5:
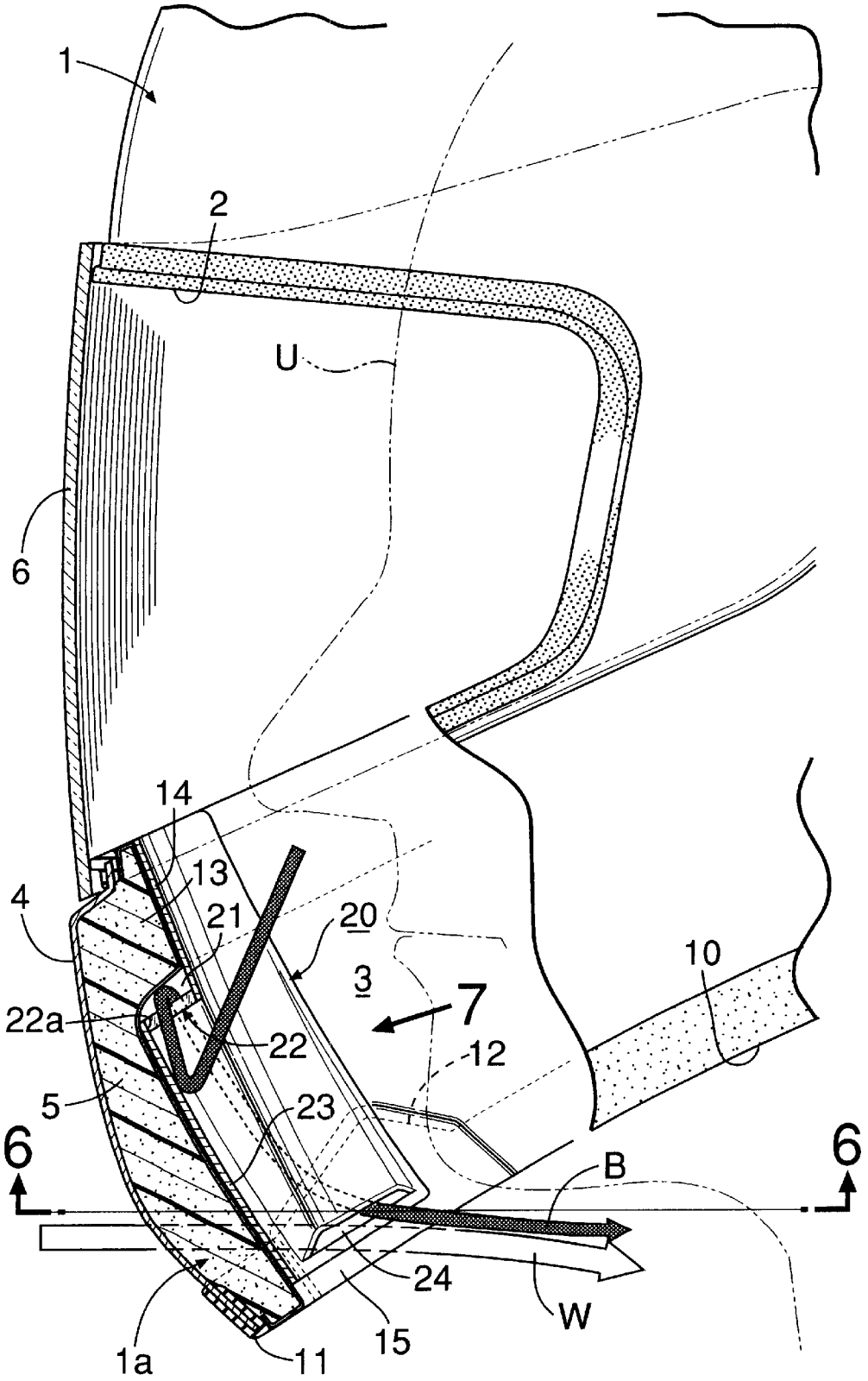
FIG. 5 is a sectional view similar to FIG. 2, but showing a third embodiment of the present invention.
Figure 6:
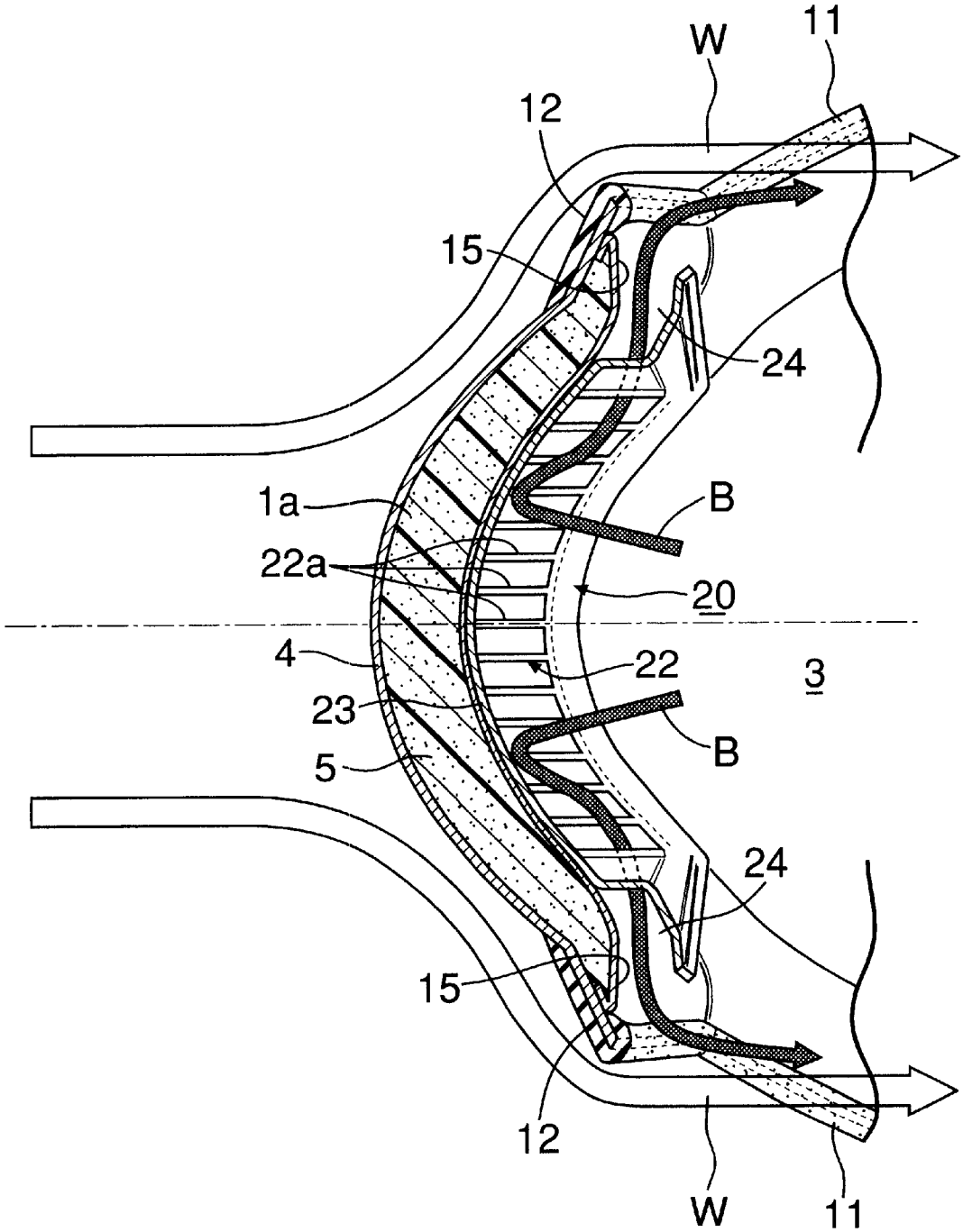
FIG. 6 is a sectional view taken along a line 6—6 in FIG. 5.
Figure 7:
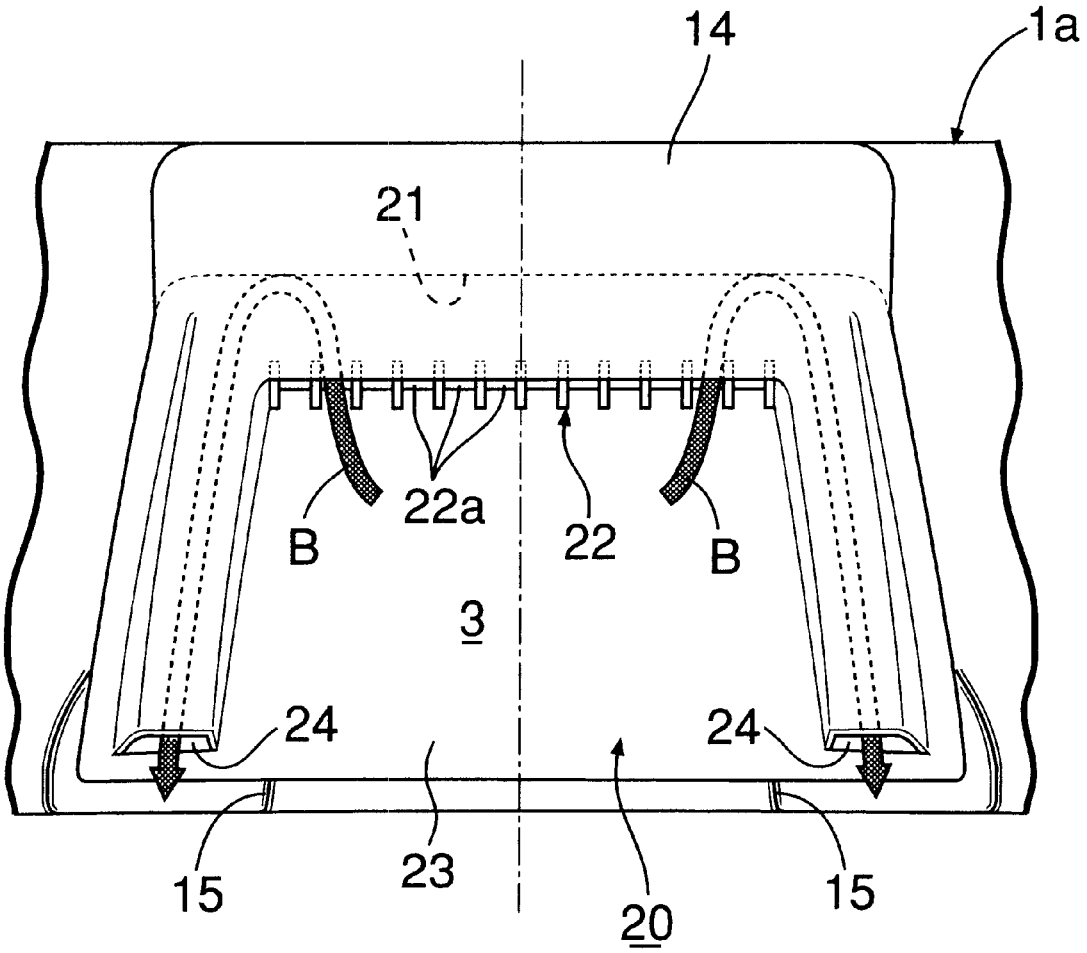
FIG. 7 is a view taken in a direction of an arrow 7 in FIG. 5.

Finally, a third embodiment of the present invention will now be described with reference to FIGS. 5 to 7.

A breath-discharge plate 20 is disposed in a chin-covering portion 1*a* to lead to a baffle plate 14. The breath-discharge plate 20 is comprised of a louver 22 bent forwards from a lower end of the baffle plate 14 to define a horizontal passage 21 between the louver 22 itself and a lower surface of a projecting wall 13, a guide plate portion 23 bent downwards from a front end of the louver 22 along an inner surface of the chin-covering portion 1*a*, and a pair of left and right discharge passages 24 defined in left and right opposite ends of the guide plate portion 23 to permit the passage 21 to communicate with the breath-discharge recesses 15 in left and right inner surfaces of the chin-covering portion 1*a*. A plurality of ventilating bores 22*a* are defined in the louver 22 and open into the passage 21.

The other arrangement is the same as in the first embodiment. Therefore, portions and components corresponding to those in the first embodiment are designated by the same reference numerals and symbols in FIGS. 5 to 7, and the description of them is omitted.

With the third embodiment, when a negative pressure generated behind the bulges 12 at left and right outer surfaces of the chin-covering portion 1*a* due to the travel wind W passing on the bulges 12, acts on the breath-discharge recesses 15 in left and right inner surfaces of the chin-covering portion 1*a*, the negative pressure is passed through the discharge passages 24 and the passage 21, to act on the louver 22. Therefore, the breath B of a user U is guided toward the louver 22 by the guide plate 23, and passed through a plurality of ventilating bores 22*a* in the louver 22 into the passage 21 by the draw-in effect of the negative pressure. In this manner, the breath can flow smoothly to the outside through the left and right discharge passages 24 and the left and right recesses 15. Thus, the discharge of the breath B to below the chin-covering portion 1*a* can be promoted more effectively to increase the effect of preventing the fogging of an inner surface of a shield plate 6.

Although the embodiments of the present invention have been described in detail, it will be understood that the present invention is not limited to the above-described embodiments, and various modifications in design may be made without departing from the spirit and scope of the invention defined in claims.

What is claimed is:

1. A full-face type helmet for vehicular users, comprising a chin-covering portion provided on a cap body to define a space for breathing of a user, while forming a lower portion under a window in a front face of the cap body, wherein the chin-covering portion includes a lower end edge which is formed to be directed upwards in a backward direction on wearing position of the cap body, and bulges formed at left and right outer surfaces of the chin-covering portion to be continuous to the lower end edge, so that travel wind is passed on outer surfaces of the bulges to traverse the lower end edge, thereby generating a negative pressure or vacuum below the chin-covering portion.

2. A full-face type helmet for vehicular users according to claim 1, wherein the chin-covering portion has breath-discharge recesses provided in its inner surface at locations corresponding to the bulges to open at the lower portion of the chin-covering portion.

3. A full-face type helmet for vehicular users according to claim 1, wherein the bulges are formed by outwardly bulging a lower end of a shell of the chin-covering portion.

4. A full-face type helmet for vehicular users according to claim 1, wherein the bulges are integrally formed on an outer surface of a beading member mounted to a peripheral edge of a lower end of a shell of the cap body.

5. A full-face type helmet according to claim 2, wherein the chin-covering portion has a protruding wall formed on its inner surface to extend along the lower portion under the window, and a baffle plate for inhibiting the ascending of the user's breath is mounted on the protruding wall to protrude downwards.

6. A full-face type helmet according to claim 5, further comprising a breath-discharge plate disposed in the chin-covering portion, the breath-discharge plate including: a louver extending forwards from a lower end of the baffle plate to define a horizontal passage between the louver itself and a lower surface of the projecting wall and having a plurality of ventilating bores; a guide plate bent downwards from a front end of the louver along an inner surface of the chin-covering portion; and a pair of left and right discharge passages defined in left and right opposite ends of the guide plate to permit the passage to communicate with the breath-discharge recesses.

7. A full-face type helmet for vehicular users according to claim 2, wherein the bulges are formed by outwardly bulging a lower end of a shell of the chin-covering portion.

8. A full-face type helmet for vehicular users according to claim 2, wherein the bulges are integrally formed on an outer surface of a beading member mounted to a peripheral edge of a tower end of a shell of the cap body.

9. A full-face type helmet for vehicular users according to claim 1, further including a shield plate which covers the window.

10. A full-face type helmet according to claim 1, wherein the chin-covering portion has a protruding wall formed on its inner surface to extend along the lower portion under the window, and a baffle plate for inhibiting the ascending of the user's breath is mounted on the protruding wall to protrude downwards.

11. A full-face type helmet according to claim 10, further comprising a breath-discharge plate disposed in the chin-covering portion, the breath-discharge plate including: a louver extending forwards from a lower end of the baffle plate to define a horizontal passage between the louver itself and a lower surface of the projecting wall and having a plurality of ventilating bores; a guide plate bent downwards from a front end of the louver along an inner surface of the chin-covering portion; and a pair of left and right discharge passages defined in left and right opposite ends of the guide plate to permit the passage to communicate with breath-discharge recesses defined at the bulges.

* * * * *

UNITED STATES PATENT AND TRADEMARK OFFICE

CERTIFICATE OF CORRECTION

PATENT NO. : 6,640,345 B2
DATED : November 4, 2003
INVENTOR(S) : Haruo Tanaka

It is certified that error appears in the above-identified patent and that said Letters Patent is hereby corrected as shown below:

Column 6,
Line 54, change "of a tower end of a shell of the cap body." to
-- of a lower end of a shell of the cap body. --.

Signed and Sealed this

Thirtieth Day of March, 2004

JON W. DUDAS
*Acting Director of the United States Patent and Trademark Office*